US010988981B2

(12) United States Patent
Lei et al.

(10) Patent No.: US 10,988,981 B2
(45) **Date of Patent: *Apr. 27, 2021**

(54) PULL-CORD CONTROL DEVICE FOR CURTAIN WITHOUT OPERATION CORD

(71) Applicant: Leafy Windoware Co., Ltd., Dongguan (CN)

(72) Inventors: Zhenbang Lei, Shenzhen (CN); Xingbang Lei, Shenzhen (CN)

(73) Assignee: Leafy Windoware Co., Ltd., Dongguan (CN)

( * ) Notice: Subject to any disclaimer, the term of this patent is extended or adjusted under 35 U.S.C. 154(b) by 127 days.

This patent is subject to a terminal disclaimer.

(21) Appl. No.: 16/082,935

(22) PCT Filed: Dec. 16, 2016

(86) PCT No.: PCT/CN2016/110246

§ 371 (c)(1),
(2) Date: Sep. 7, 2018

(87) PCT Pub. No.: WO2018/107447

PCT Pub. Date: Jun. 21, 2018

(65) Prior Publication Data

US 2019/0024448 A1 Jan. 24, 2019

(51) Int. Cl.
*E06B 9/322* (2006.01)
*E06B 9/324* (2006.01)
(Continued)

(52) U.S. Cl.
CPC ..... *E06B 9/324* (2013.01); *A47H 11/00* (2013.01); *E06B 9/322* (2013.01); *E06B 9/323* (2013.01);
(Continued)

(58) Field of Classification Search
CPC ..... E06B 9/80; E06B 2009/801; E06B 2009/802; E06B 2009/807; E06B 9/322;
(Continued)

(56) References Cited

U.S. PATENT DOCUMENTS 814,458 A * 3/1906 Kramer ..... A62B 1/14 188/65.5
2,674,350 A * 4/1954 Moyer ..... E06B 9/324 188/64
(Continued)

FOREIGN PATENT DOCUMENTS

CN 204552578 U 8/2015
CN 205036272 U 2/2016
(Continued)

*Primary Examiner* — Daniel P Cahn

(57) ABSTRACT

A pull-cord control device for a curtain without an operation cord includes a pull-cord (3), a base (1), and a pressing plate (2) rotatably mounted to the base through a rotation shaft (42). The base forms first friction shafts (11). The pressing plate forms second friction shafts (21) staggered with the first friction shafts. The pressing plate forms a fixing pole (41). A first end of the pull-cord is connected to a retractable-cord device (5), and a second end of the pull-cord extends between the first and second friction shafts, and is connected to a curtain body (6) after extending about the fixing pole. When the curtain body moves up and down, the pressing plate is rotated between a clamping position and a loose position. When the pressing plate is in the clamping portion, the second friction shafts actuate the pull-cord to wander between the first and second friction shafts.

8 Claims, 11 Drawing Sheets

(51) Int. Cl.
*E06B 9/327* (2006.01)
*E06B 9/323* (2006.01)
*A47H 11/00* (2006.01)

(52) U.S. Cl.
CPC ..... *E06B 9/327* (2013.01); *E06B 2009/3222* (2013.01)

(58) Field of Classification Search
CPC .. E06B 2009/3222; E06B 9/324; E06B 9/327; E06B 9/323; E06B 9/32; E06B 9/326; E06B 9/38; A47H 11/00
USPC ..... 188/65.5
See application file for complete search history.

(56) References Cited

U.S. PATENT DOCUMENTS 4,114,726 A * 9/1978 Sentinella ..... A62B 1/06 182/5
4,256,199 A * 3/1981 Sellards ..... A62B 1/00 182/11
7,398,815 B2 7/2008 Liang
8,167,086 B1 5/2012 Brendley et al.
8,662,135 B2 * 3/2014 Lin ..... E06B 9/322 160/168.1 R
9,708,851 B2 7/2017 Huang
9,879,476 B2 * 1/2018 Sung ..... E06B 9/322
10,221,619 B2 * 3/2019 Chen ..... E06B 9/322
2003/0111189 A1 * 6/2003 Palmer ..... E06B 9/322 160/170
2003/0111191 A1 * 6/2003 Ciuca ..... E06B 9/90 160/170
2006/0278348 A1 * 12/2006 Huang ..... E06B 9/322 160/170
2007/0084569 A1 4/2007 Lin
2008/0099159 A1 * 5/2008 Nien ..... E06B 9/30 160/170
2009/0223642 A1 * 9/2009 Militello ..... E06B 9/324 160/340
2015/0136336 A1 * 5/2015 Huang ..... E06B 9/322 160/170
2018/0171706 A1 * 6/2018 Yamagishi ..... F16D 63/008
2018/0347269 A1 * 12/2018 Wang ..... E06B 9/38

FOREIGN PATENT DOCUMENTS

CN 106691139 A 5/2017
JP 2001295568 A 10/2001

* cited by examiner

PULL-CORD CONTROL DEVICE FOR CURTAIN WITHOUT OPERATION CORD

BACKGROUND OF THE INVENTION

1. Field of the Invention

The present invention generally relates to curtain accessory technology, and more specifically, relates to a pull-cord control device for a curtain without an operation cord.

2. Description of Related Art

Curtains are generally made of cloth, hemp, aluminum pieces, wood pieces, or metal materials, and have functions of shading and heat insulation and adjusting the light in the rooms. Control methods of the curtains include manual and electric methods. The manual curtains include manual opening and closing curtains, manual bead roller blinds, manual silky vertical curtains, manual wood louvers, manual Roman blinds, and manual organ curtains. The electric curtains include electric opening and closing curtains, electric roller blinds, electric silky louvers, electric canopy curtains, electric wood louvers, electric Roman blinds, and electric organ curtains. With the development of the curtains, the curtains have become indispensable interior decorations with a perfect combination of functionality and decoration.

However, an electric curtain needs to be limited by the power supply. The lifting operation of the electric curtain is troublesome without the external power supply. A traditional manual curtain not only needs a power unit for pulling back the curtain, but also needs a control device for fixing the curtain. Most of the current control devices use gear control, and gear control is easy to cause damage to pull cords of the curtains. Moreover, because the gears are made of metal, the gears are easy to rust and have high production cost. In addition, the use of gear control is not easy to adjust the amount of tension of the pull cords.

SUMMARY OF THE INVENTION

Technical Problem

A technical problem to be solved of the present disclosure is to provide a pull-cord control device for a curtain without an operation cord, to conveniently adjust the amount of friction between the control device and the pull-cord, so as to conveniently control a lifting position of the curtain.

Solutions to Problem

Technology Solutions

To resolve the above-mentioned technical problems, the present invention provides a pull-cord control device for a curtain without an operation cord. The control device includes a pull-cord, a base, and a pressing plate rotatably mounted to the base through a rotation shaft. The pressing plate forms a pressing portion that cooperates with the base to clamp or loosen the pull-cord. The base forms a plurality of first friction shafts. The first friction shafts extend from a side of the base facing the pressing portion. The pressing portion forms a plurality of second friction shafts staggered with the corresponding first friction shafts, and the second friction shafts extend from a side of the pressing portion facing the base. An end of the pressing plate forms a fixing pole. A first end of the pull-cord is connected to a retractable-cord device of the curtain, and a second end of the pull-cord extends between the first friction shafts and the second friction shafts, and is connected to a curtain body of the curtain after extending about the fixing pole. When the curtain body moves up and down, the pressing plate is rotated relative to the base between a clamping position and a loose position about the rotation shaft under the action of the pull-cord. When the pressing plate is in the clamping portion, the second friction shafts actuate the pull-cord to wander between the first friction shafts and the second friction shafts.

Furthermore, the pressing plate includes two parallel side plates, opposite ends of the fixing pole are disposed between ends of the side plates away from the pressing portion.

Furthermore, the base defines a slot for accommodating the pressing portion, the first friction shafts are disposed between two sidewalls of the slot.

Furthermore, when the pressing portion and the base are in the clamping position, a distance between upper edges of the first friction shafts and a bottom wall of the slot is greater than a distance between lower edges of the second friction shafts and the bottom wall of the slot.

Furthermore, each of the first friction shafts and the second friction shafts comprises a shaft core and a friction-material layer wrapped around the shaft core.

Furthermore, a total number of the first friction shafts and the second friction shafts is not less than three, and a difference between the numbers of the first shafts and the second shafts is not more than one.

Furthermore, the second friction shafts are disposed between the side plates, and bottom sides of the side plates define a plurality of avoiding recesses corresponding to the first friction shafts.

Furthermore, the rotation shaft is located at an end of the pressing plate away from the fixing pole, or located between the fixing pole and the pressing portion of the pressing plate.

Advantages of the Invention

Advantages

According to the above-mentioned technical solutions, the present disclosure has at least the following advantages. The embodiment of the present disclosure provides the first friction shafts on the base and the second friction shafts on the pressing plate. The use of the first friction shafts and the second friction shafts can effectively increase the friction between the device and the pull-cord. By changing the number and positional relationship of the first friction shafts and the second friction shafts, the friction between the pull-cord and the first friction shafts and the second friction shafts can be controlled. The friction between the first friction shafts, the second friction shafts and the pull-cord is superimposed by the gravity of the curtain itself, and can be balanced with the pulling force of the retractable-cord device, so that the curtain can be arbitrarily adjusted to any height, so as to facilitate the lifting operation of the curtain body.

DESCRIPTION OF THE DRAWINGS

Brief Description of the Drawings

Brief Description

Figure 1:
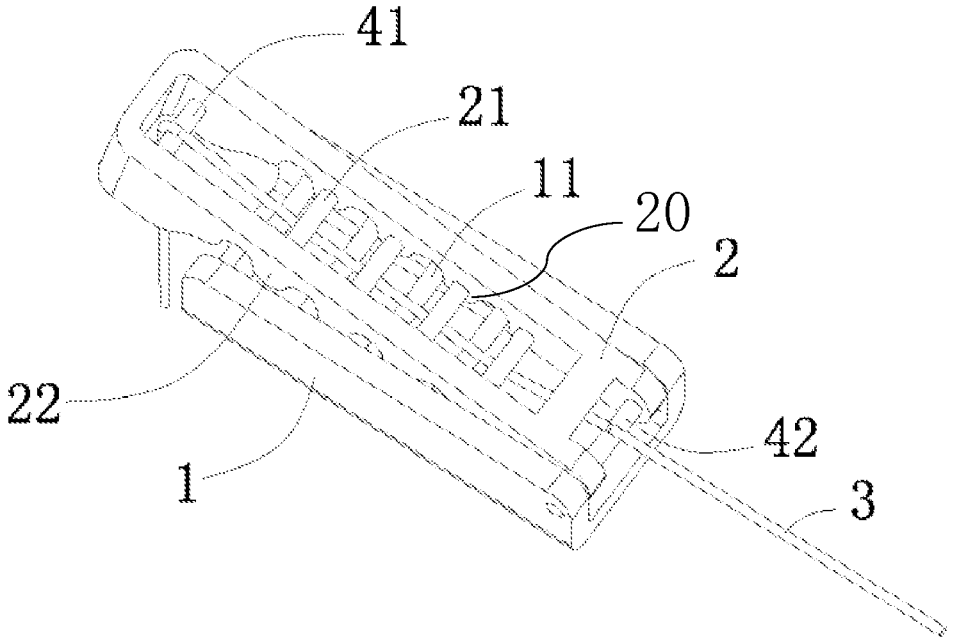

FIG. 1 is an isometric view of a pull-cord control device for a curtain without an operation cord of an embodiment of the present invention, showing the control device in a loose position.

Figure 2:
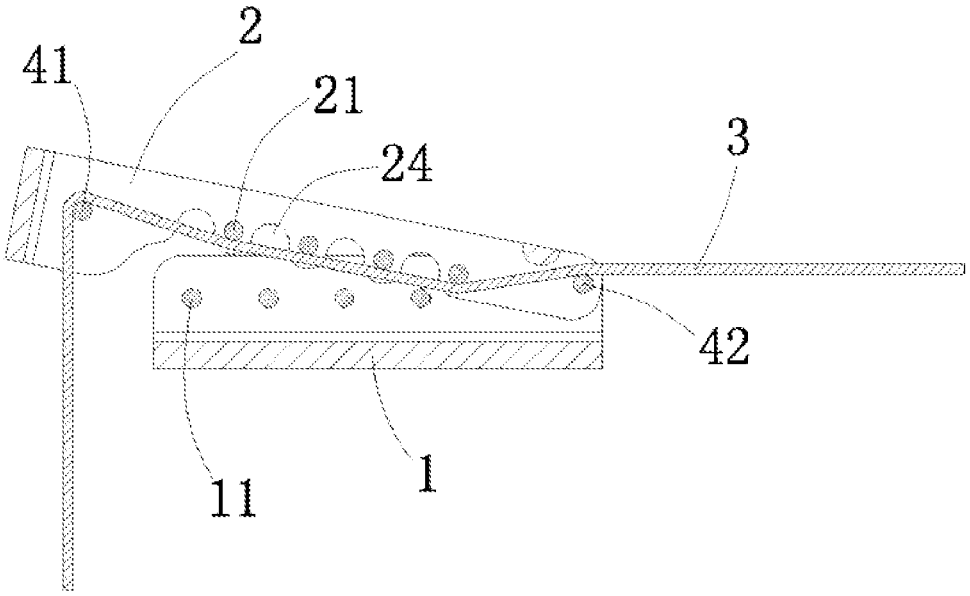

FIG. 2 is a cross-sectional view of FIG. 1, taken along the pull-cord.

Figure 3:
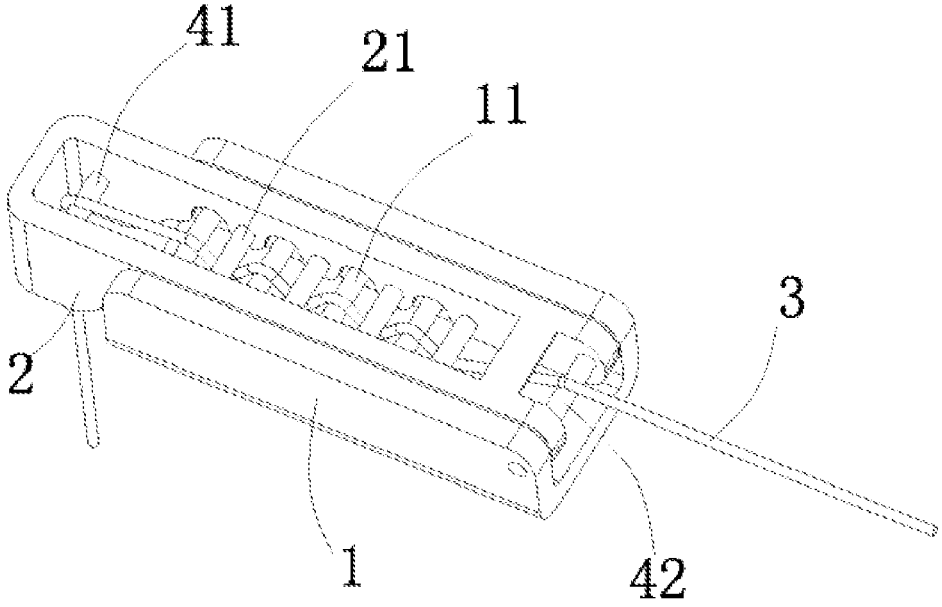

FIG. 3 is an isometric view of the pull-cord control device, showing the control device in a clamping position.

Figure 4:
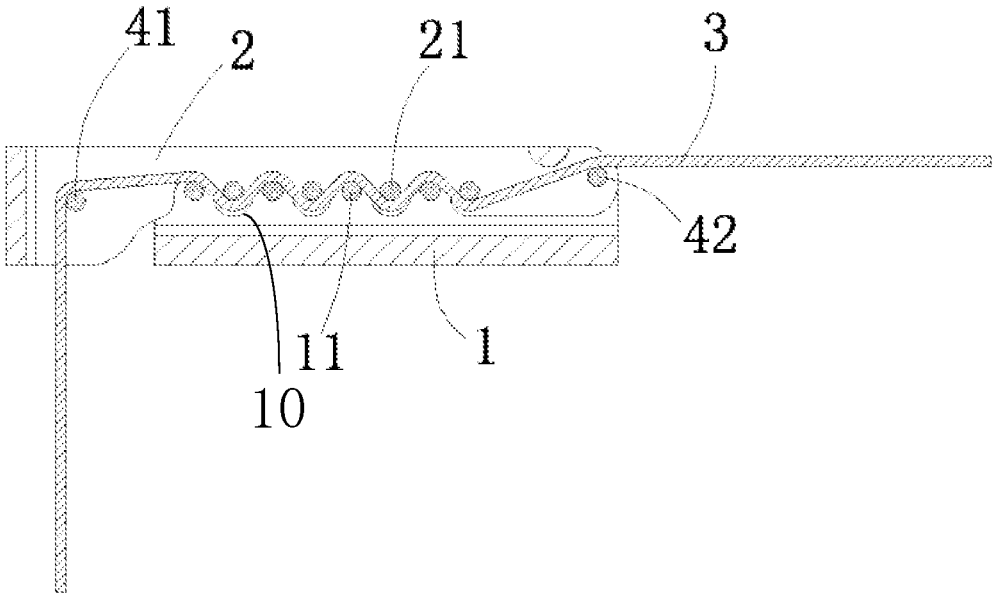

FIG. 4 is a cross-sectional view of FIG. 3, taken along the pull-cord.

Figure 5:
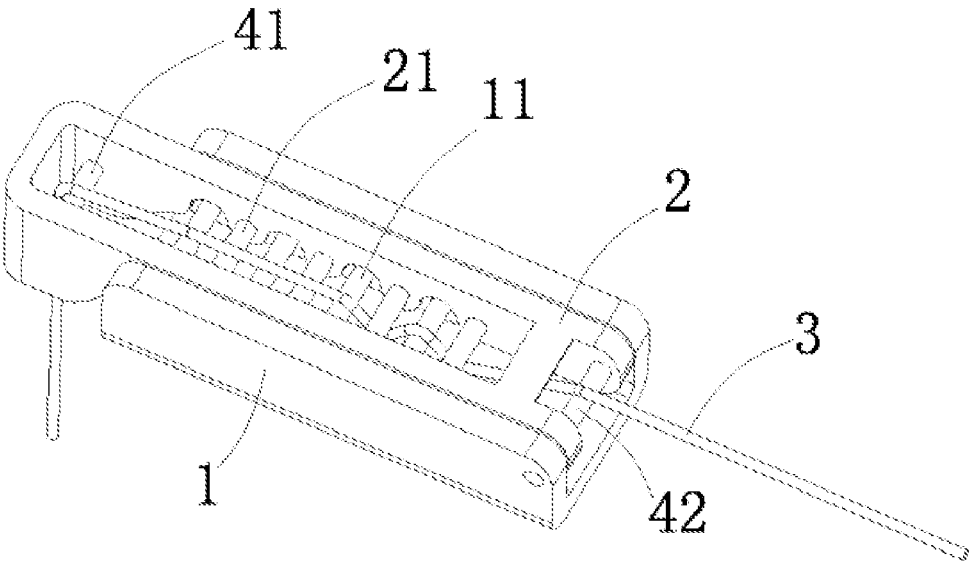

FIG. 5 is an isometric view of the pull-cord control device, showing the control device in another use state and in a clamping position.

Figure 6:
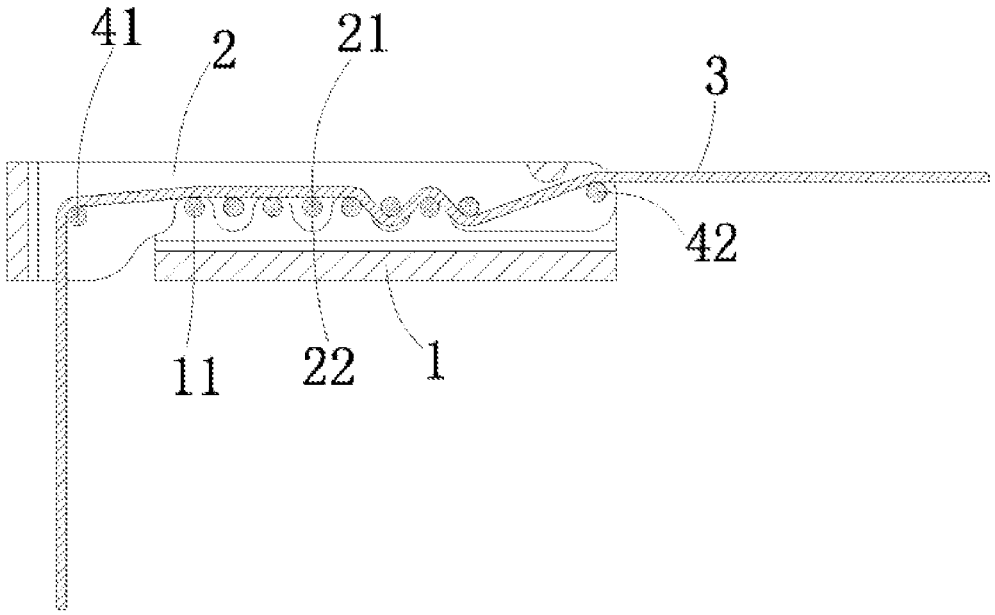

FIG. 6 is a cross-sectional view of FIG. 5, taken along the pull-cord.

Figure 7:
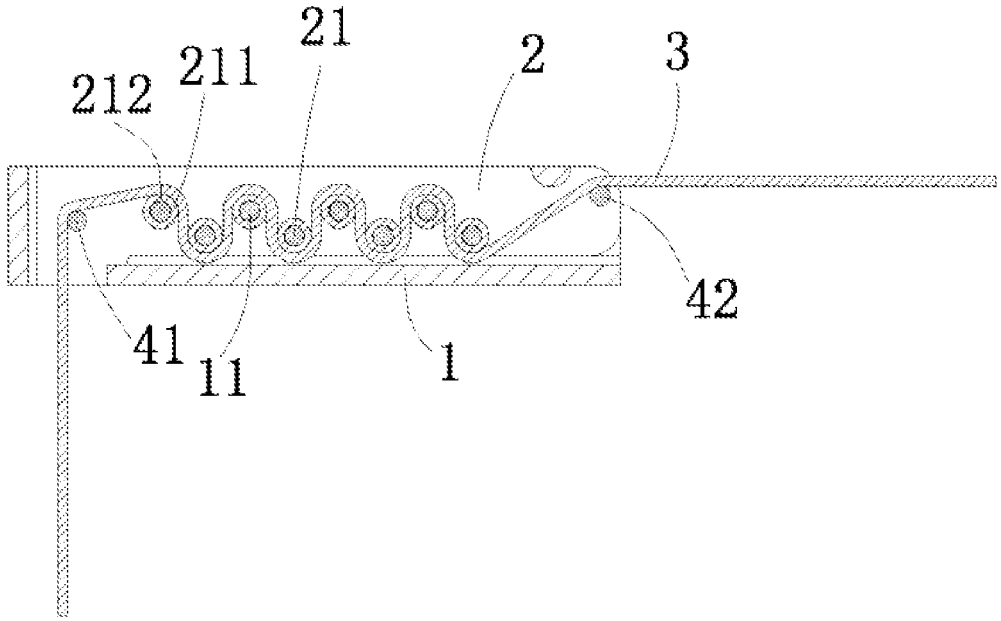

FIG. 7 is a cross-sectional view of a pull-cord control device for a curtain without an operation cord of another embodiment, taken along the pull-cord.

Figure 8:
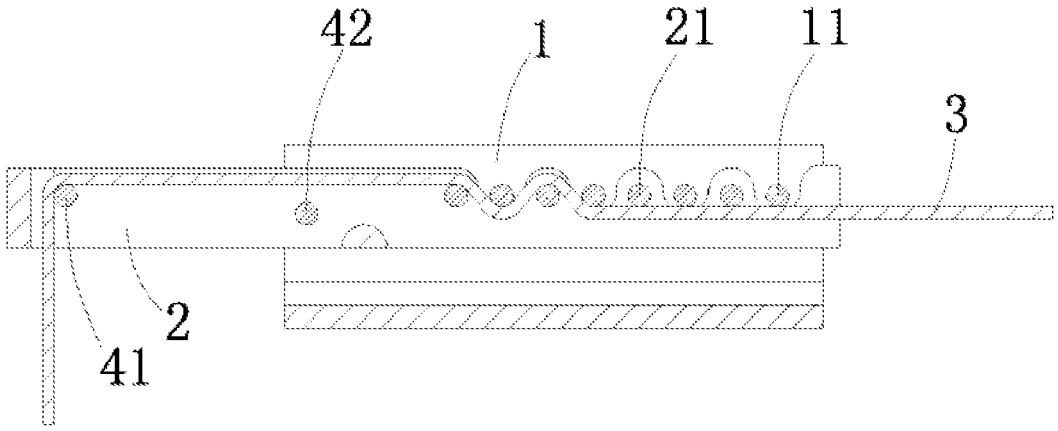

FIG. 8 is a cross-sectional view of a pull-cord control device for a curtain without an operation cord of another embodiment, showing the control device in a clamping position.

Figure 9:
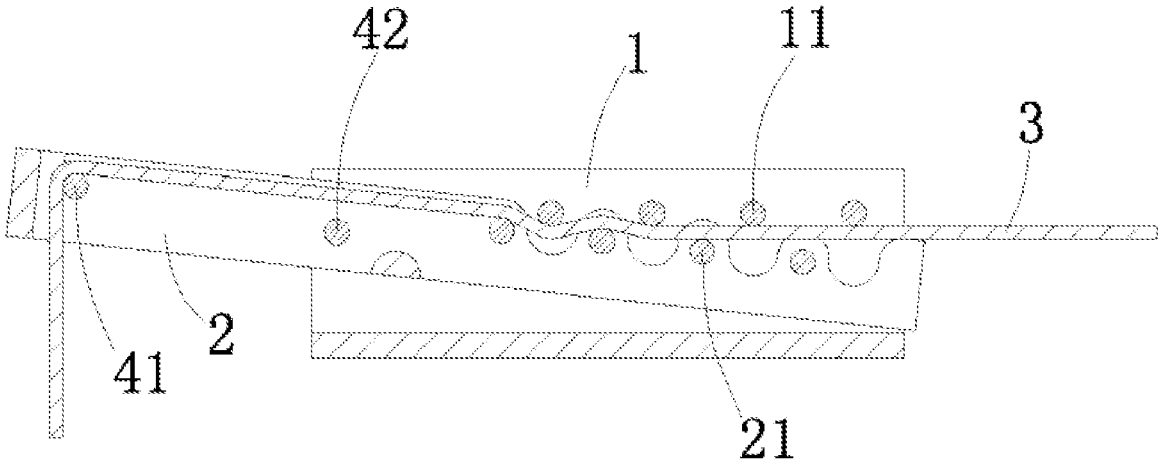

FIG. 9 is a cross-sectional view of the pull-cord control device of FIG. 8, but showing the control device in a loose position.

Figure 10:
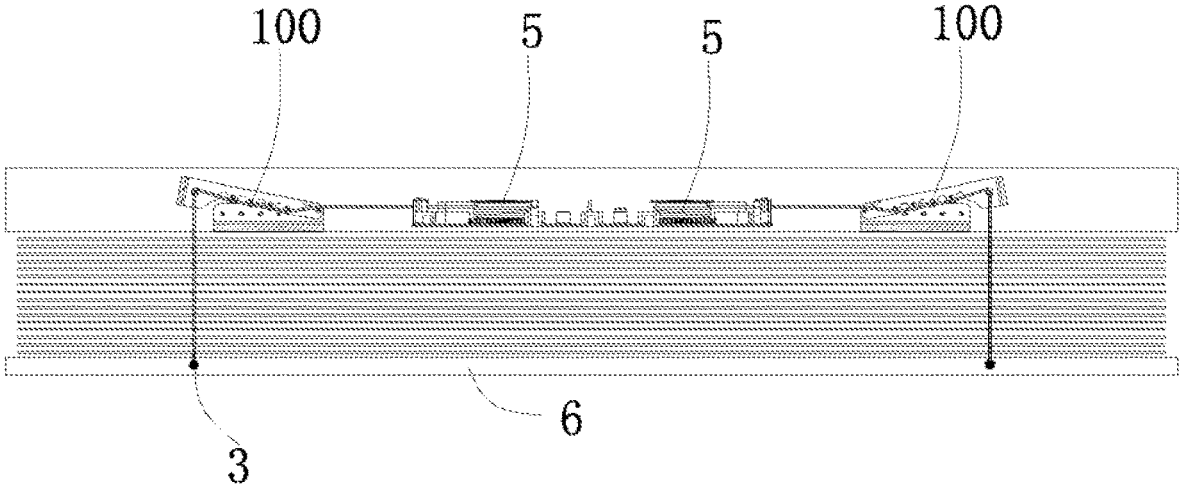

FIG. 10 is a plan view of the control device of the present disclosure being used in a curtain, showing the pull-cord in a shrinking state.

Figure 11:
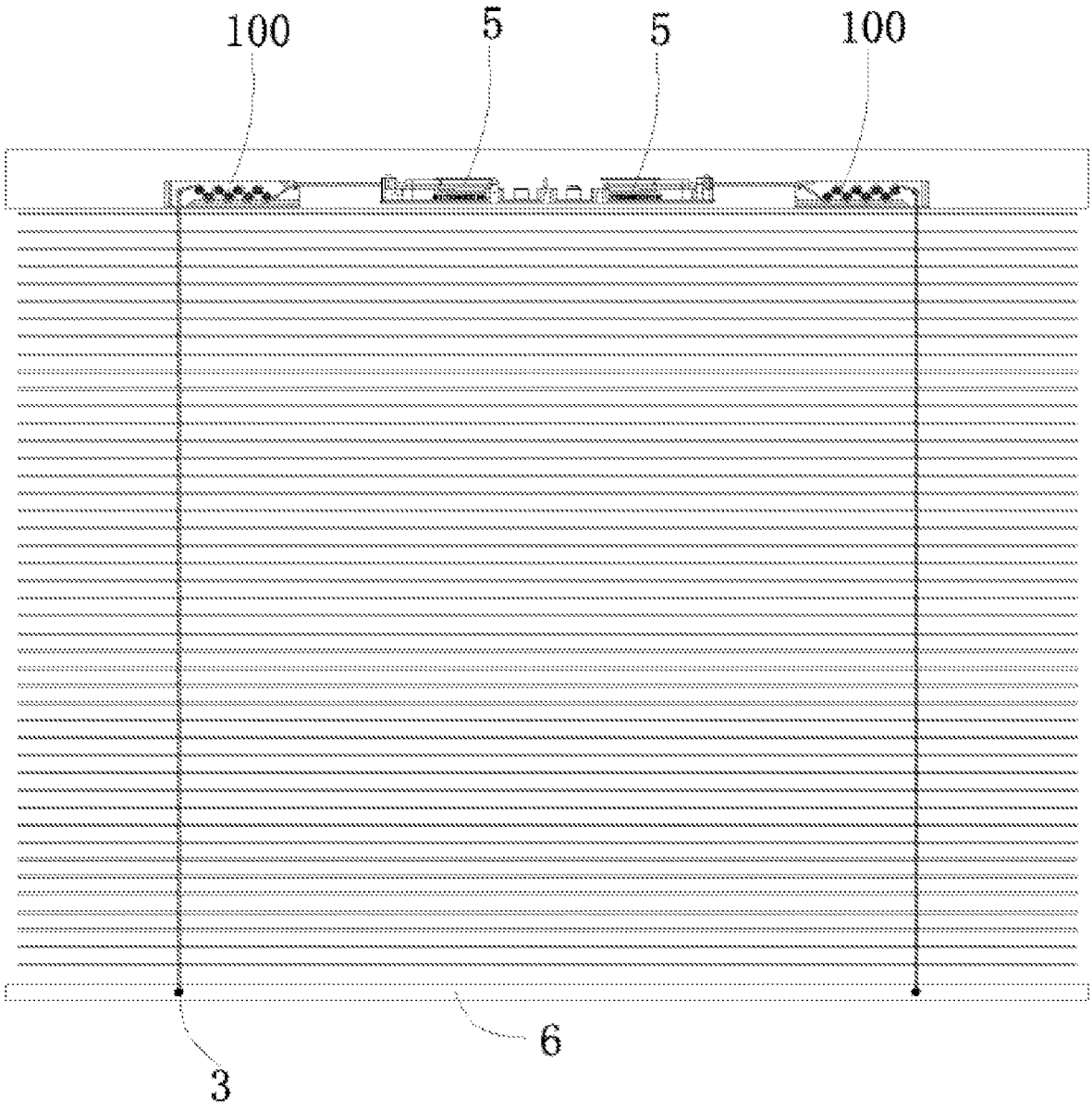

FIG. 11 is a plan view of the control device of the present disclosure being used in a curtain, showing the pull-cord in a loose state.

DETAILED DESCRIPTION OF THE INVENTION

Embodiments of the Invention

Embodiments of the Present Invention

The invention will be further described in detail below with reference to the accompanying drawings and specific embodiments. It is to be understood that the following illustrative embodiments and illustrations are merely illustrative of the invention, and are not intended to limit the invention, and the embodiments of the present invention and the features of the embodiments may be combined with each other without conflict.

Referring to FIGS. 1-6, a pull-cord control device for a curtain without an operation cord of an embodiment of the present disclosure includes a base 1, and a pressing plate 2 rotatably mounted to the base 1 through a rotation shaft 42. The pressing plate 2 includes a pressing portion 20 cooperating with the base 1 to be clamped with the base 1 or loosened from the base 1. The base 1 forms a plurality of first friction shafts 11 extending from a side of the base 1 facing the pressing portion 20. The pressing portion 20 forms a plurality of second friction shafts 21 extending from a side of the pressing portion 20 facing the base 1, and the second friction shafts 21 are staggered with the first friction shafts 11. An end of the pressing plate 2 forms a fixing pole 41. An end of a pull-cord 3 of the curtain is connected to a retractable-cord device 5 of the curtain. An opposite end of the pull-cord 3 extends between the first friction shafts 11 and the second friction shafts 21, and is connected to a curtain body 6 of the curtain after extending about the fixing pole 41. When the curtain body 6 moves up and down, the pressing portion 20 is actuated by the pull-cord 3 to rotate between a clamping position and a loose position relative to the base 1. When the pressing portion 20 is in the clamping position, the second friction shafts 21 actuates the pull-cord 3 to wander between the first friction shafts 11 and the second friction shafts 21.

The embodiment of the present disclosure provides the first friction shafts 11 on the base 1 and the second friction shafts 21 on the pressing plate 2. The use of the first friction shafts 11 and the second friction shafts 21 can effectively increase the friction between the control device and the pull-cord 3. By changing the number and positional relationship of the first friction shafts 11 and the second friction shafts 21, it is possible to control the amount of friction between the pull-cord 3 and the first and second friction shafts 11 and the second friction shafts 21. The gravity of the curtain itself is superimposed by the friction between the first and second friction shafts 11 and 21 and the pull-rope 3 can be balanced with the pulling force of the retractable-cord device 5, so that the curtain body 6 of the curtain can be arbitrarily adjusted to any height to facilitate the lifting operation of the curtain body 6.

In an alternative embodiment, the pressing plate 2 includes two parallel side plates 22. Opposite ends of the fixing pole 41 are disposed between ends of the side plates 22 away from the pressing portion 20.

In the embodiment, forming the fixing pole 41 can obtain a support point for the rotation of the pressing plate 2 driven by the pull-cord 3. Using the principle of the lever, the pressing plate 2 can be moved in a direction away from the base 1 when the retractable-cord device 5 retracts the curtain body 6.

In an alternative embodiment, the base 1 defines a slot 10 for accommodating the pressing portion 20. The first friction shafts 11 are disposed between opposite sidewalls of the slot 10.

In the embodiment, defining the slot 10 facilitates fixing the position of the pressing portion 20, so that the cooperation between the base 1 and the pressing plate 2 is more stable, and the control device can be more streamlined.

In an alternative embodiment, when the pressing portion 20 and the base 1 are in the clamping position, a distance between upper edges of the first friction shafts 11 and a bottom wall of the slot 10 is greater than a distance between lower edges of the second friction shafts 21 and the bottom wall of the slot 10.

In the embodiment, the distance between the upper edges of the first friction shafts 11 and the bottom wall of the slot 10 is greater than the distance between the lower edges of the second friction shafts 21 and the bottom wall of the slot 10, so as to ensure that there is contact area between the pull-cord 3 and the first friction shafts 11 and the second friction shafts 21, and the friction is provided.

Referring to FIG. 7, in an alternative embodiment, each of the first friction shafts 11 and the second friction shafts 21 includes a shaft core 211 and a friction-material layer 212 wrapped around the shaft core 211.

In the embodiment, adding the friction-material layer 212 enables the pull-cord 3 to be completely abutted against surfaces of the first friction shafts 11 and the second friction shafts 21, so as to effectively increase the contact area between the pull-cord 3 and the first friction shafts 11 and the second friction shafts 21, thereby improving the friction.

In an alternative embodiment, a total number of the first friction shafts 11 and the second friction shafts 21 is not less than three, and a difference between the numbers of the first shafts 11 and the second shafts 21 is not more than one.

In an alternative embodiment, the second friction shafts 21 are disposed between the two side plates 22, and bottom sides of the side plates 22 further define avoiding recesses 24 (as labeled in FIG. 2) corresponding to the first friction shafts 11.

In the embodiment, defining the avoiding recesses 24 corresponding to the first friction shafts 11 can function to fix and limit the first friction shafts 11, and can also make a greater staggered setting of the second friction shafts 21 and the first friction shafts 11.

Referring to FIGS. 8 and 9, in an alternative embodiment, the rotation shaft 42 is located at an end of the pressing plate 2 away from the fixing pole 41. In another alternative embodiment, the rotation shaft 42 is located between the fixing pole 41 and the pressing portion 20 of the pressing plate 2.

In the embodiment, according to the principle of the lever, the rotation shaft 42 can be flexibly disposed at one end or the middle of the pressing plate 2, so as to effectively improve the flexibility of the control device.

In an alternative embodiment, the base 1 and the pressing plate 2 are integrally formed by injection molding, and the injection molding integrated molding method is beneficial to improve production efficiency and save production cost.

Referring to FIGS. 10 and 11, in use, an end of the pull-cord 3 is connected to the curtain body 6 of the curtain, and an opposite end of the pull-cord 3 is connected to the retractable-cord device 5. When the curtain body 6 needs to be pulled down, the curtain body 6 is pulled down. At this time, the pull-cord control device is in the clamping position. The second friction shafts 21 actuates the pull-cord 3 to wander between the first friction shafts 11 and the second friction shafts 21, so that a frictional force is generated between the pull-cord 3 and the first friction shafts 11 and the second friction shafts 21. Therefore, the curtain body 6 is fixed at any position. When the curtain body 6 needs to be lifted up, since the gravity of the curtain body 6 is constant with the strength of the operator under the human factor, the retractable-cord device 5 will retract the pull-cord 3. By lever principle, the pressing portion 20 rotates about the rotation shaft 42 under the action of the pull-cord 3, so that the pull-cord control device is in the loose position. The curtain body 6 is pulled up by the pulling force of the retractable-cord device 5, and after adjusting a position of the curtain body 6, the curtain body 6 is pulled down again, so that the pull-cord control device is in the clamping position, thereby fixing the curtain body 6. The device is simple and convenient to use, easy to be controlled, and can set different frictional forces according to different situations to meet the needs of different types of curtains.

While the embodiments of the present disclosure have been shown and described, it is understood by those skilled in the art that various changes, modifications, replacement, and variants can be made in the embodiments without departing from the principles and spirit of the present disclosure. The scope of the present disclosure is defined by the appended claims and their equivalents.

What is claimed is:

1. A pull-cord control device for a curtain without an operation cord, comprising:

a pull-cord;

a base forming at least one first friction shaft; and a pressing plate rotatably mounted to the base through a rotation shaft, and forming a pressing portion that cooperates with the base to clamp or loosen the pull-cord;

wherein the at least one first friction shaft extends from a side of the base facing the pressing portion, the pressing portion forms at least one second friction shaft staggered with the at least one first friction shaft, the at least one second friction shaft extends from a side of the pressing portion facing the base;

wherein an end of the pressing plate forms a fixing pole, a first end of the pull-cord is connected to a retractable-cord device of the curtain, a second end of the pull-cord extends between the at least one first friction shaft and the at least one second friction shaft, and is connected to a curtain body of the curtain after extending about the fixing pole in a direction from the first end to the second end; and wherein when the curtain body moves up and down, the pressing portion is actuated by the pull-cord to rotate about the rotation shaft relative to the base between a clamping position and a loose position; when the pressing portion is in the clamping position, the at least one second friction shaft actuates the pull-cord to travel through the at least one first friction shaft and the at least one second friction shaft in an S-shaped path.

2. The pull-cord control device for the curtain without the operation cord of claim 1, wherein the pressing plate comprises two parallel side plates, opposite ends of the fixing pole are disposed between ends of the side plates away from the pressing portion.

3. The pull-cord control device for the curtain without the operation cord of claim 1, wherein the base defines a slot for accommodating the pressing portion, the at least one first friction shaft is disposed between two sidewalls of the base and in the slot.

4. The pull-cord control device for the curtain without the operation cord of claim 3, wherein when the pressing portion and the base are in the clamping position, a distance between an upper edge of the at least one first friction shaft and a bottom wall of the base is greater than a distance between a lower edge of the at least one second friction shaft and the bottom wall of the base.

5. The pull-cord control device for the curtain without the operation cord of claim 1, wherein each of the at least one first friction shaft and the at least one second friction shaft comprises a shaft core and a friction-material layer wrapped around the shaft core.

6. The pull-cord control device for the curtain without the operation cord of claim 1, wherein a total number of the at least one first friction shaft and the at least one second friction shaft is not less than three, and a difference between the numbers of the at least one first friction shaft and the at least one second friction shaft is not more than one.

7. The pull-cord control device for the curtain without the operation cord of claim 2, wherein the at least one second friction shaft is disposed between the side plates, and each of bottom sides of the side plates defines at least one avoiding recess corresponding to the at least one first friction shaft.

8. The pull-cord control device for the curtain without the operation cord of claim 1, wherein the rotation shaft is located at an end of the pressing plate away from the fixing pole, or located between the fixing pole and the pressing portion of the pressing plate.

* * * * *